US009531098B2

(12) United States Patent
Takahashi et al.

(10) Patent No.: US 9,531,098 B2
(45) Date of Patent: Dec. 27, 2016

(54) TERMINAL AND METHOD FOR MANUFACTURING TERMINAL

(71) Applicant: YAZAKI CORPORATION, Minato-ku, Tokyo (JP)

(72) Inventors: Takakazu Takahashi, Shizuoka (JP); Takamichi Kudo, Shizuoka (JP); Yoshikatsu Nishida, Osaka (JP); Takahiro Fujii, Osaka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/714,371

(22) Filed: May 18, 2015

(65) Prior Publication Data

US 2015/0333425 A1 Nov. 19, 2015

(30) Foreign Application Priority Data

May 19, 2014 (JP) ..... 2014-103637

(51) Int. Cl.
*H01R 13/02* (2006.01)
*H01R 13/03* (2006.01)
*H01R 43/16* (2006.01)

(52) U.S. Cl.
CPC ..... *H01R 13/03* (2013.01); *H01R 13/02* (2013.01); *H01R 43/16* (2013.01); *Y10T 29/49226* (2015.01)

(58) Field of Classification Search
CPC ..... H01R 13/03; H01R 13/02; H01R 43/16; H01R 4/723; Y10T 29/49226; H01M 4/8626
USPC ..... 439/887
See application file for complete search history.

(56) References Cited

U.S. PATENT DOCUMENTS 5,064,978 A * 11/1991 Scholz ..... H01R 4/723 219/605
6,878,461 B2 * 4/2005 Kobayashi ..... B23K 35/262 205/109
2014/0030630 A1 * 1/2014 Dawson ..... H01M 4/8626 429/498
2015/0280340 A1 * 10/2015 Anderson ..... H01R 13/03 439/524

FOREIGN PATENT DOCUMENTS

JP 2012-129012 A 7/2012

* cited by examiner

*Primary Examiner* — Jean Frantz Duverne
(74) *Attorney, Agent, or Firm* — Mots Law, PLLC

(57) ABSTRACT

A terminal (1) comprising a connecting portion (15) to be connected to a connecting portion (5) of a mating terminal (3), wherein the connecting portion (15) includes a portion of a base material (19) including iron or an iron-based alloy and having a fine asperity (25) on a surface of the portion of the base material (19), a first layer (21) formed on a surface of at least the portion of the base material (19) included in the connecting portion (15) and having a surface formed into the fine asperity pattern, and a second layer (23) formed on the surface of the first layer (21), wherein the first layer (21) is provided for connecting the base material (19) and the second layer (23) to each other, and has higher hardness than the second layer (23), and the second layer (23) is provided for enhancing conductivity and lubrication property.

19 Claims, 8 Drawing Sheets

TERMINAL AND METHOD FOR MANUFACTURING TERMINAL

CROSS REFERENCE TO RELATED APPLICATIONS

This application claims the priority of Japanese Patent Application No. 2014-103637, filed on May 19, 2014, the entire content of which are incorporated herein by reference.

BACKGROUND

Technical Field

The present invention relates to a terminal and a method for manufacturing a terminal, and more particularly to a terminal which is used for connection with a mating terminal.

Related Art

Conventionally, there has been known the connection structure 301 of a terminal (terminal fitting) shown in FIGS. 9 to 12 (refer to JP 2012-129012 A).

The connection structure 301 of the terminal includes: a male terminal (male terminal fitting) 305 having a tab (tab portion) 303; and a female terminal (female terminal fitting) 309 having a cylindrical body portion 307 into which the tab 303 is insertable. The connection structure 301 of the terminal is provided with an elastic contact member 311 which is elastically brought into contact with the tab 303 of the male terminal 305 in the inside of the body portion 307 of the female terminal 309.

Further, the connection structure 301 of the terminal is configured such that the tab 303 inserted into the inside of the body portion 307 is sandwiched between the body portion 307 (one side wall portion of the body portion) and the elastic contact member 311 so that a connection state between both terminals 305, 309 is maintained.

In the connection structure 301 of the terminal, the above-mentioned connection state is maintained also by mounting the male terminal 305 and the female terminal 309 on a housing 313. Further, in the connection structure 301 of the terminal, a plurality of groove portions 315 are formed on the tab 303 for suppressing a minute slide abrasion.

SUMMARY

In the conventional connection structure 301 of the terminal, a minute slide abrasion is suppressed by forming the groove portions 315. However, when vibrations are received by the respective terminals 305, 309 in a connection state, there is a possibility that a minute slide abrasion slightly occurs in the connecting portion between the respective terminals 305, 309. That is, the conventional connection structure 301 of the terminal has a problem that there may be a case where electric resistance is increased at a contact portion (connecting portion).

When copper or a copper alloy is adopted as a material for forming the female terminal 305 or the male terminal 309, the female terminal 305 or the male terminal 309 exhibits an excellent strength, an easy-to-bend property, and high conductivity. When iron or an iron based alloy (stainless steel) is adopted in place of copper or a copper alloy as an alternative technique as a material for forming the female terminal 305 or the male terminal 309, the female terminal 305 or the male terminal 309 has advantages such as high hardness, an inexpensive cost and a small change in contact pressure generated by a change in temperature or the like. Particularly, the terminal formed by adopting stainless steel minimally corrodes. On the other hand, conductivity is low and electric resistance is increased.

The present invention has been made in view of the above-mentioned problem, and it is an object of the present invention to provide a terminal which can prevent the increase of electric resistance of a connecting portion brought about by a minute slide abrasion generated when the terminal receives vibrations in a connection state or the like.

According to one aspect of the present invention, a terminal includes a connecting portion to be connected to a connecting portion of a mating terminal. The connecting portion includes a portion of a base material including iron or an iron-based alloy and having a fine asperity on a surface of the portion of the base material, a first layer formed on a surface of at least the portion of the base material included in the connecting portion and having a surface formed into the fine asperity pattern, and a second layer formed on the surface of the first layer. The first layer is provided for connecting the base material and the second layer to each other, and has higher hardness than the second layer, and the second layer is provided for enhancing conductivity and lubrication property.

The base material may include stainless steel, the first layer may include nickel, and the second layer may include any one of tin, silver, and gold.

The fine asperity may extend in a direction orthogonal to a sliding direction of the connecting portion or in a direction intersecting the sliding direction of the connecting portion at an almost right angle.

The connecting portion of the terminal may be a tab portion of a male terminal.

According to another aspect of the present invention, a method for manufacturing a terminal including a connecting portion to be connected to a connecting portion of a mating terminal, the method includes a surface roughening step roughening a surface of a portion of a base material including stainless steel and including the connecting portion, a first layer forming step forming a first layer including nickel at least on the surface of the portion including the connecting portion which is roughened by the surface roughening step, and a second layer forming step forming a second layer including any one of tin, silver, and gold on the surface of the first layer which is formed in the first layer forming step.

According to the present invention, it is possible to acquire an advantageous effect that it is possible to provide a terminal which can prevent the increase of electric resistance of a connecting portion brought about by a minute slide abrasion generated when the terminal receives vibrations in a connection state or the like.

DETAILED DESCRIPTION

Figure 1:
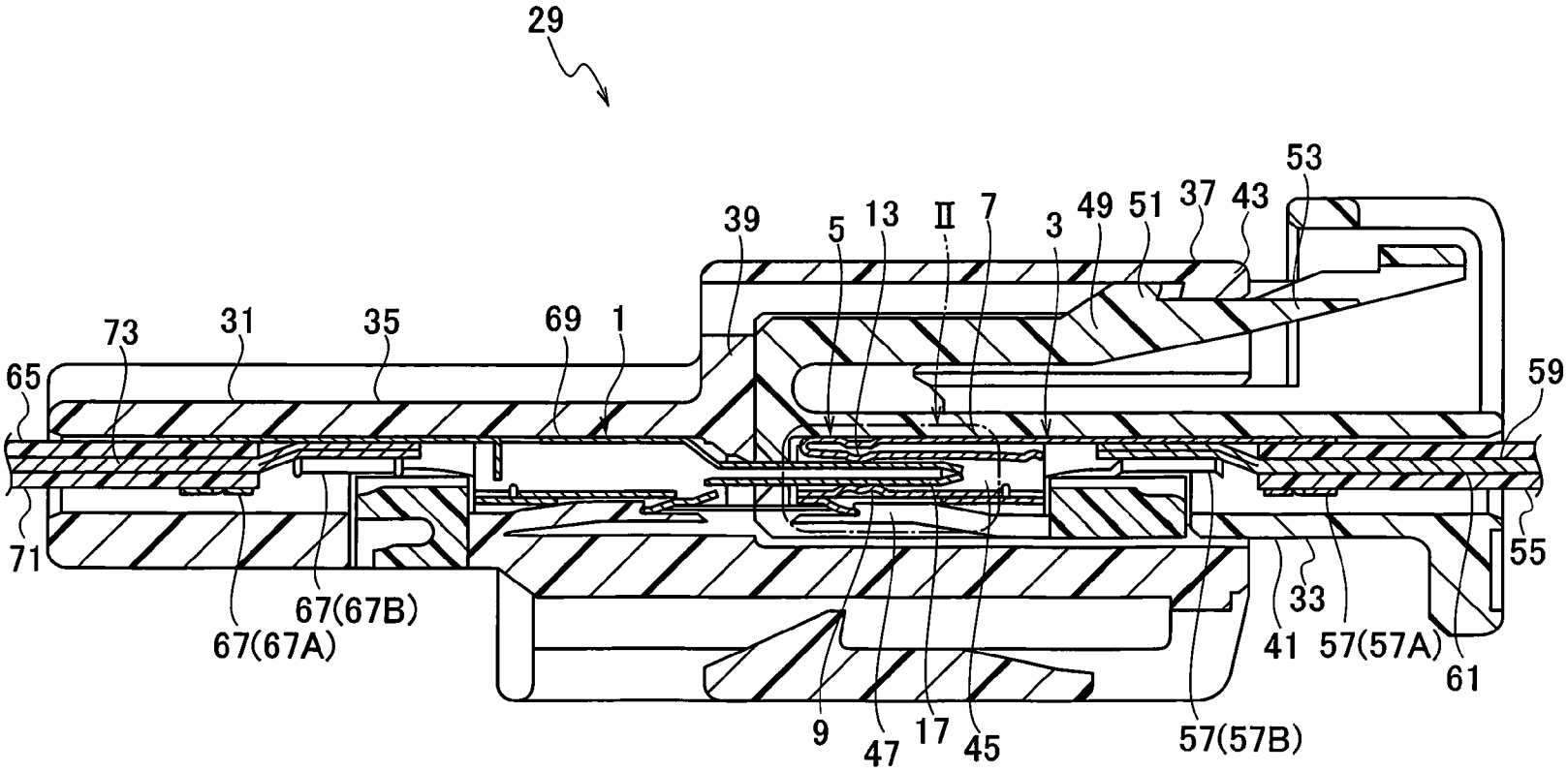
FIG. 1 is a cross sectional view showing the schematic constitution of the connection structure of a terminal where a male terminal according to an embodiment of the present invention is used.
Figure 2:
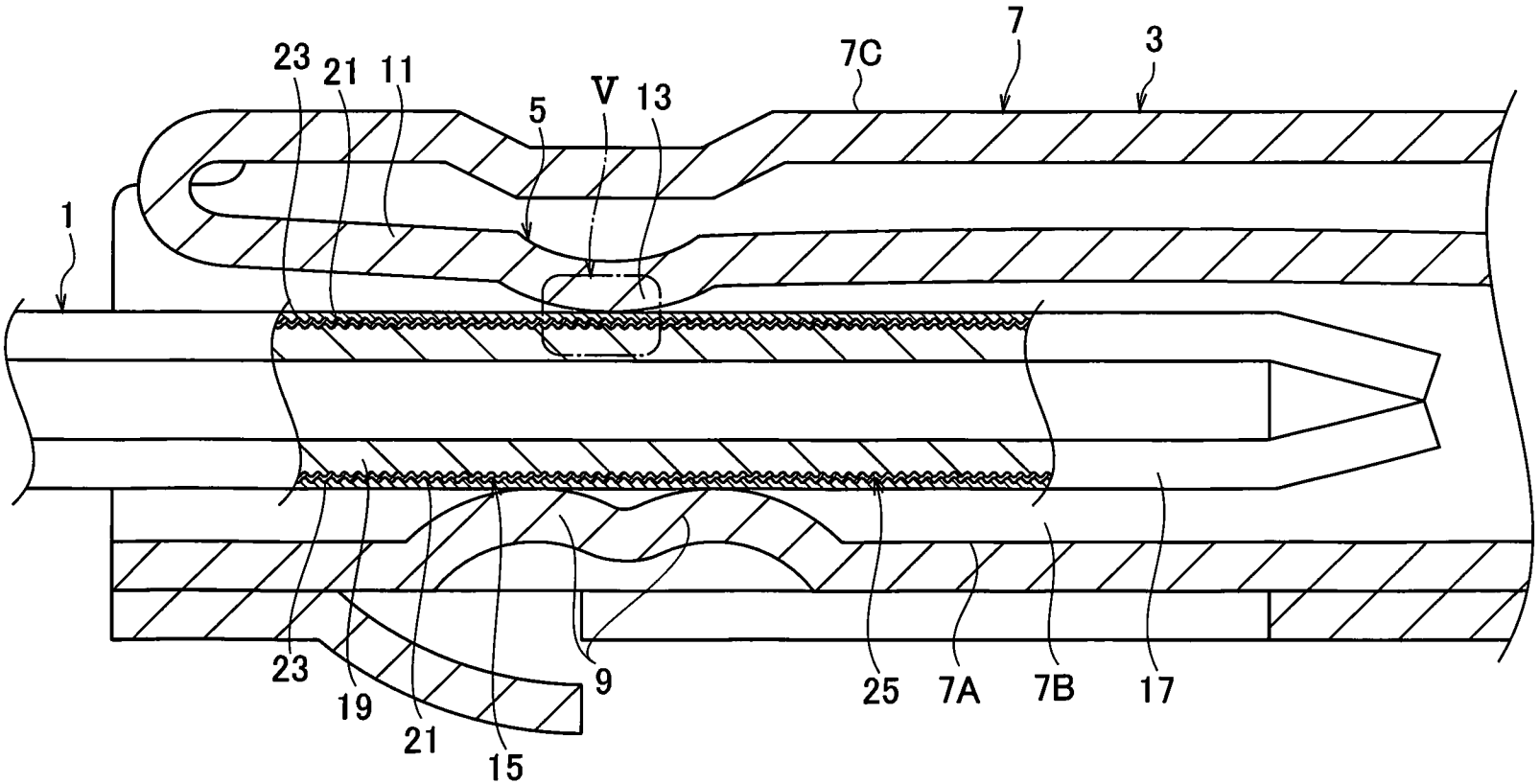
FIG. 2 is an enlarged view of a portion II in FIG. 1.

A terminal (first terminal; male terminal, for example) 1 according to an embodiment of the present invention includes, as shown in FIG. 1, FIG, 2 and the like, a connecting portion (first connecting portion) 15 electrically connected to a connecting portion (second connecting portion) 5 of a mating terminal (second terminal; female terminal, for example) 3.

As the connecting portion 5 of the female terminal 3, for example, a projecting portion 9 of a cylindrical portion (box-like portion) 7 of the female terminal 3 and a projecting portion 13 of an elastic contact member 11 can be named. As the connecting portion 15 of the male terminal 1, for example, a tab portion 17 of the male terminal 1 can be named. The detail of the connecting portion 5 of the female terminal 3 and the like is described later.

Figure 4:
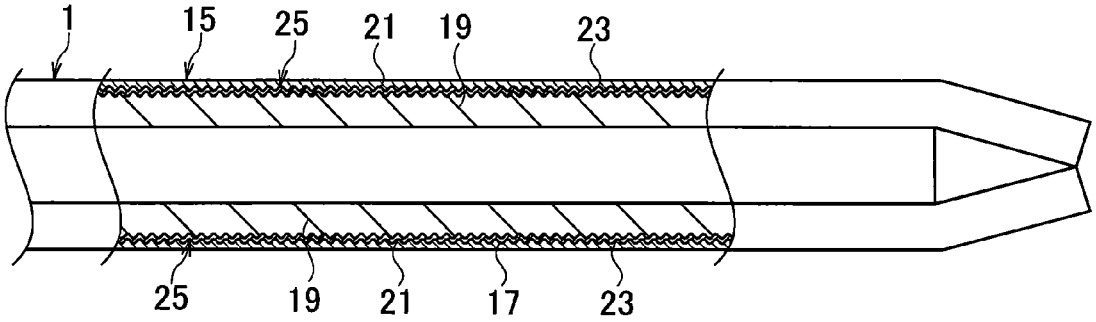
FIG. 4 is a view showing the detail of a tab portion of the male terminal according to the embodiment of the present invention.
Figure 5A:
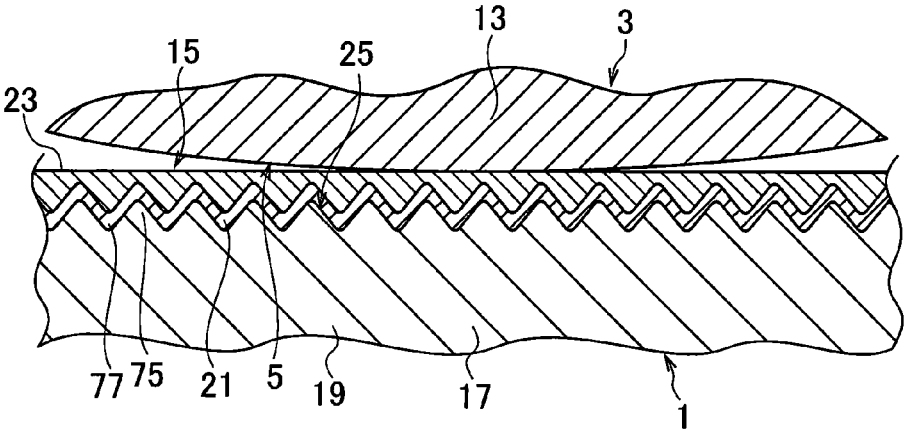
FIG. 5A is an enlarged view of a portion V in FIG. 2 showing a state before a minute slide abrasion occurs.

As shown in FIG. 4, FIG. 5A and the like, the tab portion 17 of the male terminal 1 includes a base material (substrate material) 19 including stainless steel, a first layer 21 and a second layer 23.

The first layer 21 includes nickel. The first layer 21 is integrally formed on the surface of the base material 19 such that the first layer 21 covers the surface of the base material 19 (for example, a surface of at least the tab portion 17 of the base material 19 or a surface of at least a portion of the tab portion 17 which is brought into slide contact with the projecting portions 9 and the projecting portion 13 of the female terminal 3). The first layer (nickel layer) 21 may be formed on the base material 19 by plating, for example.

The second layer 23 includes tin. The second layer 23 is integrally formed on a surface of the nickel layer 21 such that the second layer 23 covers the surface of the nickel layer 21. The second layer (tin layer) 23 is formed on the nickel layer 21 in an overlapping manner by plating, for example. The second layer 23 may be formed using silver or gold in place of tin.

Figure 3A:
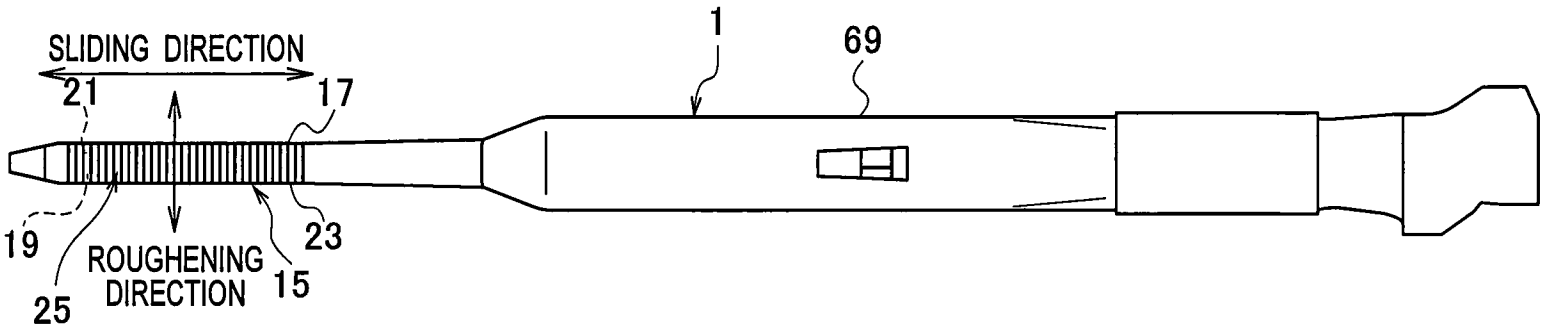
FIG. 3A is a plan view of the male terminal according to the embodiment of the present invention.
Figure 3B:
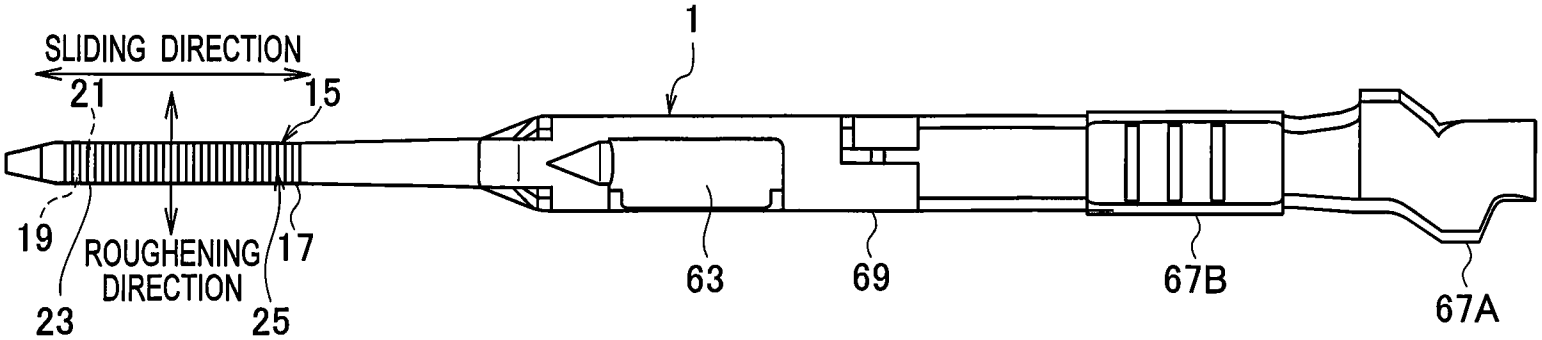
FIG. 3B is a back view of the male terminal according to the embodiment of the present invention.

As shown in FIGS. 3A, 3B and the like, a fine asperity 25 is formed on the surface of the base material 19. The fine asperity 25 extends in the direction orthogonal to the sliding direction of the tab portion 17 (the direction that the tab portion 17 slides relative to the connecting portion 5 of the female terminal 3 when the tab portion 17 is connected to the connecting portion 5 of the female terminal 3). This fine asperity 25 is formed by roughening the surface of the base material 19, for example. The fine asperity 25 is formed before the nickel layer 21 is formed.

It is not always necessary that the fine asperity 25 extends in the direction orthogonal to the sliding direction of the tab portion 17, and the fine asperity 25 may extend in the direction that the fine asperity 25 intersects with the sliding direction of the tab portion 17 at an almost right angle (substantially orthogonal direction; for example, the direction that the fine asperity 25 intersects with the sliding direction of the tab portion 17 at an angle of 60° to 120°). Further, the fine asperity 25 may extend in the direction that the fine asperity 25 intersects the sliding direction of the tab portion 17 at an arbitrary angle (the direction that the fine asperity 25 intersects with the sliding direction of the tab portion 17 at an angle larger than 0° and smaller than 180°) or the fine asperity 25 may extend in the same direction as the sliding direction of the tab portion 17.

Figure 6:
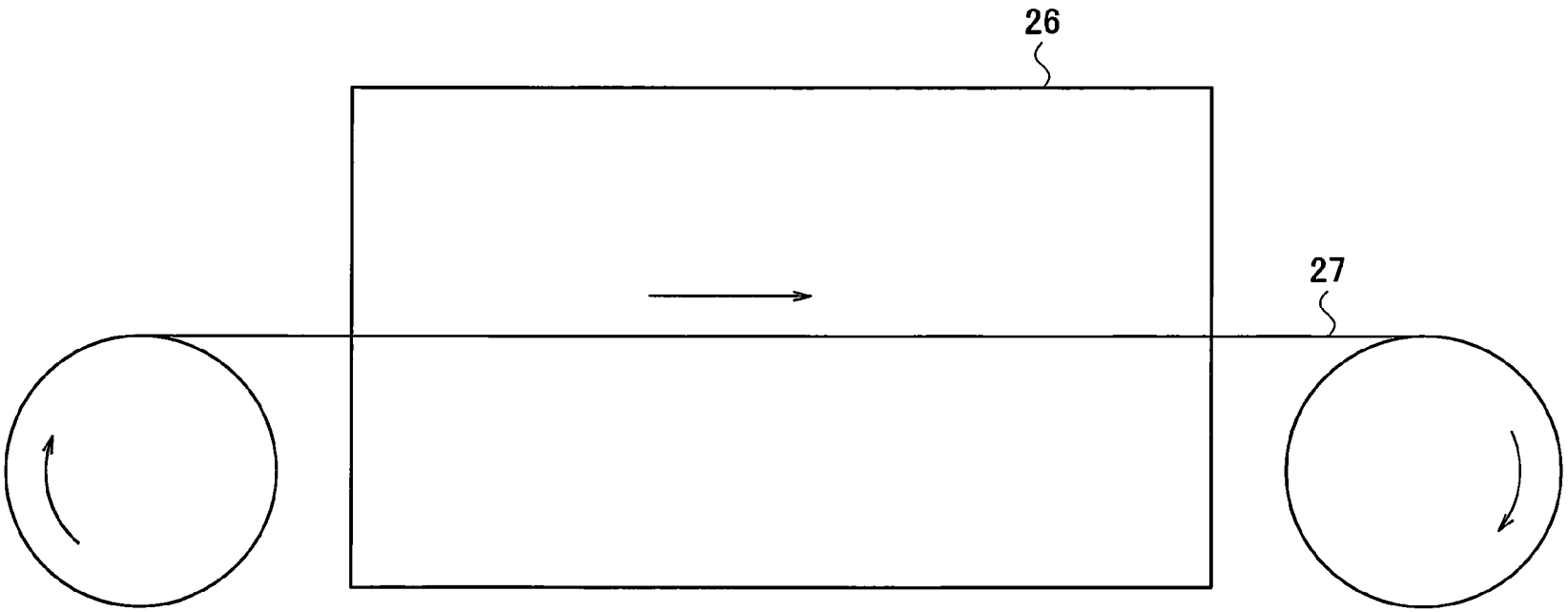
FIG. 6 is a view showing manufacturing steps (rolling and roughening) of the male terminal according to the embodiment of the present invention.
Figure 7A:
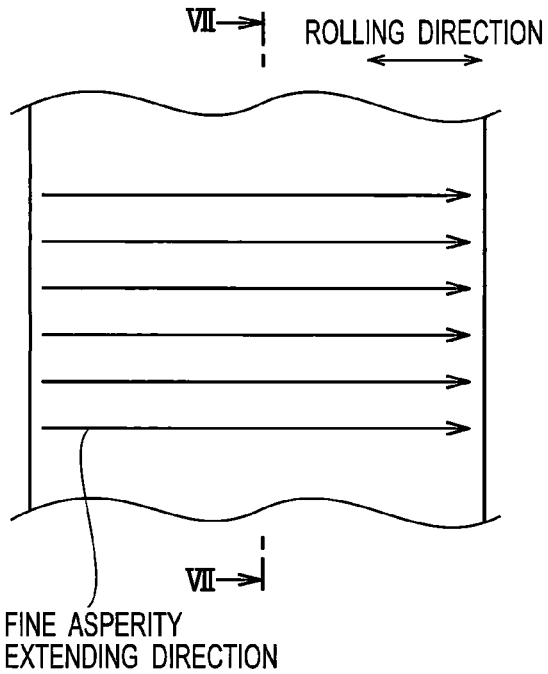
FIG. 7A is a view showing a state where roughening is finished at a tab portion of the male terminal according to the embodiment of the present invention.
Figure 7B:
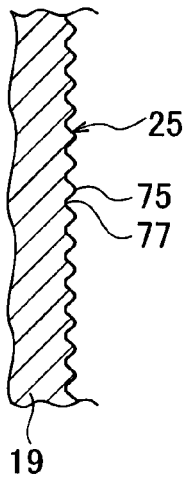
FIG. 7B is a cross-sectional view taken along a line VII-VII in FIG. 7A.

The male terminal 1 is formed by applying working to a flat-plate-like material 27 formed by rolling as shown in FIG. 6. The extending direction of the fine asperity 25 is equal to the rolling direction as shown in FIGS. 7A to 8B.

The connection structure 29 of the terminal constituted of the male terminal 1, the female terminal 3 and the like is described in more detail.

As has been already understood, the connection structure 29 of the terminal is the structure for connecting the male terminal 1 having the tab portion 17 and the female terminal 3 having the cylindrical body portion (cylindrical portion) 7 into which the tab portion 17 is insertable.

As shown in FIG. 1 and the like, the male terminal 1 is mounted in a male connecter 31, and the female terminal 3 is mounted in a female connecter 33. The male connecter 31 and the female connecter 33 are connected to each other by engaging both terminals 1, 3 by fitting engagement. Hereinafter, with respect to the respective constitutional members, fitting surface sides of both connecters 31, 33 are assumed as front sides respectively, and an upper portion side of FIG. 1 is assumed as an upper side and a lower portion side of FIG. 1 is assumed as a lower side.

A synthetic resin housing (male housing) 35 of the male connecter 31 has a hood portion 37 projecting toward a front side. The tab portion 17 of the male terminal 1 is housed in the inside of the hood portion 37. The tab portion 17 projects toward a front side from a depth-side wall 39 of the hood portion 37. On an upper wall of the hood portion 37, a male lock portion 43 which engages with a housing (female housing) 41 of the female connector 33 in a locking manner is formed. The male lock portion 43 is formed on a front end of the hood portion 37, and projects toward an inner side (lower side).

The female housing 41 includes a synthetic resin, and a cavity 45 into which the female terminal 3 is insertable from a rear side is formed in the inside of the female housing 41. A lance 47 for locking the inserted female terminal 3 at a regular position is arranged in the inside of the cavity 45.

A lock arm 49 which extends in the longitudinal direction along an upper surface of the female housing 41 is formed on the female housing 41. The lock arm 49 extends toward a rear side from a front end of the female housing 41 in a cantilever manner, and is elastically deformable in the vertical direction. A female lock portion 51, which is locked to the male lock portion 43 when the male connecter 31 and the female connecter 33 are brought into regular fitting engagement, is formed on a portion of the lock arm 49 at a position near a rear end of the lock arm 49. The female lock portion 51 projects toward an upper side from the lock arm 49. A rear end portion of the lock arm 49 functions as an operating portion 53 which is pushed at the time of releasing a locking state between the male lock portion 43 and the female lock portion 51.

The female terminal 3 is formed by blanking a conductive metal plate material (a flat plate made of metal, such as a flat plate made of stainless steel or a flat plate made of copper) and, thereafter, by applying bending, cutting and raising, hammering and the like to the blanked metal plate material. The female terminal 3 includes a barrel portion 57 connected to a terminal of an electric wire 55, and the cylindrical portion 7 into which the tab portion 17 of the male terminal 1 is inserted, and has a longitudinally elongated shape as a whole. The barrel portion 57 includes an insulation barrel 57A which crimps a coating 59 of the electric wire 55, and a wire barrel 57B which crimps a core wire 61 of the electric wire 55.

The cylindrical portion 7 is contiguously formed with a front side of the barrel portion 57. The cylindrical portion 7 is formed into a cylindrical shape (for example, an angular cylindrical shape) extending in the longitudinal direction in an elongated manner. The cylindrical portion 7 includes: a bottom plate 7A; a pair of side plates 7B raised upward from both edges of the bottom plate 7A in the width direction; and a top plate 7C which is formed by being bent from an upper end of one of the pair of side plates 7B toward an upper end of the other of the pair of side plates 7B, and is arranged substantially parallel to the bottom plate 7A. The tab portion 17 of the male terminal 1 is configured to be inserted into the inside of the cylindrical portion 7 from a front side.

A locking portion 63 to which the lance 47 is locked is formed on the bottom plate 7A of the cylindrical portion 7 in an opened manner (see FIG. 3B).

In the inside of the cylindrical portion 7, the elastic contact member 11 which is brought into elastic contact with the tab portion 17 is arranged. The elastic contact member 11 is formed into a cantilever shape such that the elastic contact member 11 is folded back from a front end of the top plate 7C and extends rearward inside the cylindrical portion 7 along the top plate 7C. The elastic contact member 11 is elastically deformable in the vertical direction.

A contact portion (a contact portion with which the tab portion 17 is brought into contact) is formed on an intermediate portion of the elastic contact member 11 in the longitudinal direction. For example, the contact portion is constituted of a projecting portion 13 which is formed into a spherical crown shape and projects downward (toward the tab portion 17 side; toward the bottom plate 7A side of the cylindrical portion 7).

A contact portion (a contact portion with which the tab portion 17 is brought into contact) is formed on an intermediate portion of the bottom plate 7A of the cylindrical portion 7 in the longitudinal direction. For example, the contact portion is constituted of two projecting portions (two projecting portions being arranged adjacent to each other in the longitudinal direction and being in contact with each other) 9, each of which is formed in a spherical crown shape, for example, and projects upward (a tab portion 17 side; a side on which the top plate 7C of the cylindrical portion 7 is arranged). The projecting portion 13 and the projecting portions 9 face each other in an opposed manner, and one projecting portion 13 is positioned between two projecting portions 9 in the longitudinal direction.

The male terminal 1 is formed by blanking a flat plate made of stainless steel and, thereafter, by applying bending cutting and raising, hammering and the like to the blanked flat plate. As shown in FIG. 1 and the like, the male terminal 1 includes: in order from a rear side to a front side, a barrel portion 67 connected to a terminal of the electric wire 65; a body portion 69 having a rectangular parallelepiped shape; and the tab portion 17. The male terminal 1 is formed in a longitudinally elongated shape as a whole. The barrel portion 67 includes an insulation barrel 67A which crimps a coating 71 of the electric wire 65, and a wire barrel 67B which crimps a core wire 73 of the electric wire 65.

The tab portion 17 is formed in an elongated rectangular cylindrical shape (or an elongated rectangular flat plate shape), and the fine asperity 25 is formed on an upper surface (a surface on a side where the surface is brought into contact with the projecting portion 13 of the female terminal 3) of the tab portion 17, and a lower surface (a surface on a side where the surface is brought into contact with the projecting portion 9 of the female terminal 3) of the tab portion 17.

As shown in FIGS. 3A, 3B and the like, the fine asperity 25 is formed by roughening (roughening working) the surface of the base material 19 in the direction substantially orthogonal to the sliding direction of the tab portion 17. Roughening working may be performed, for example, by grinding using a grindstone, by transferring a fine asperity formed on a surface of a roller used in rolling the base material 19 or by a chemical method.

To further explain the fine asperity 25, as shown in FIG. 5A and the like, the fine asperity 25 is constituted of projecting portions 75 which extend in an elongated manner in the direction orthogonal to a surface of paper on which FIG. 5A is drawn, and recessed portions 77 which extend in an elongated manner in the direction orthogonal to the surface of paper on which FIG. 5A is drawn. The longitudinal directions of the projecting portions 75 and the recessed portions 77 are set substantially orthogonal to the sliding direction (the lateral direction in FIG. 5A) of the tab portion 17. Further, the projecting portions 75 and the recessed portions 77 are alternately arranged in the sliding direction of the tab portion 17, for example.

It is not always necessary that the fine asperity 25 is formed in an elongated linear shape and may be formed in other modes. For example, fine spot-like projecting portions may be spotted at random and substantially uniformly on the surface of the base material 19 (may be present in a spotted manner).

Figure 8A:
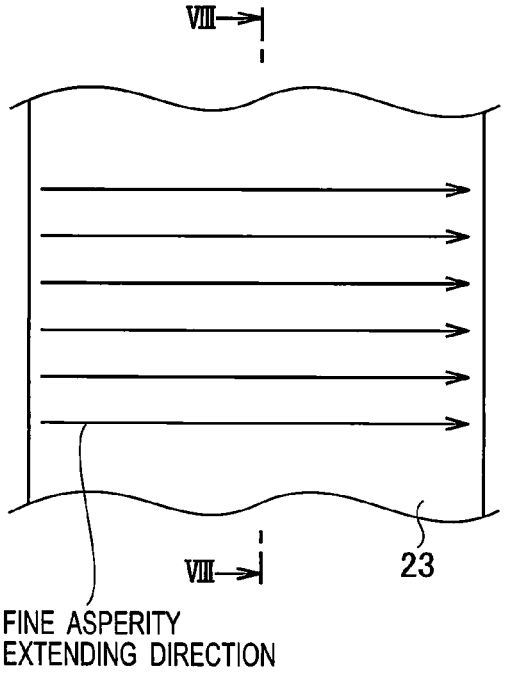
FIG. 8A is a view showing a state where plating is finished after roughening at the tab portion of the male terminal according to the embodiment of the present invention.
Figure 8B:
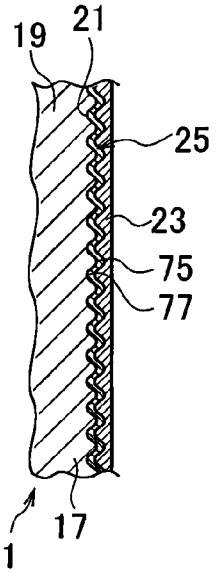
FIG. 8B is a cross-sectional view taken along a line VIII-VIII in FIG. 8A.
Figure 9:
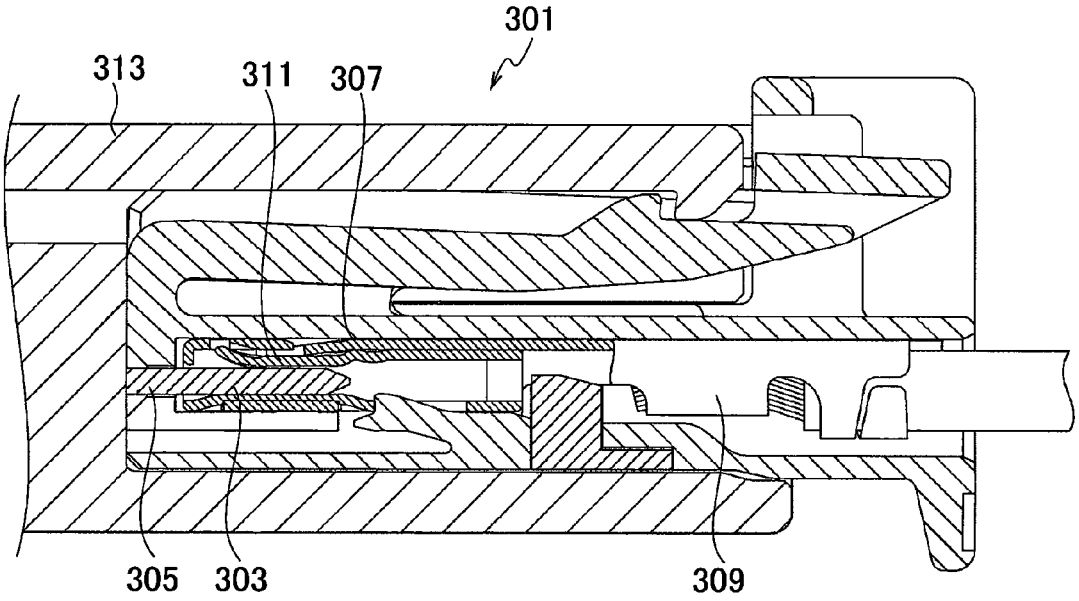
FIG. 9 is a view showing the conventional connection structure of a terminal.
Figure 10:
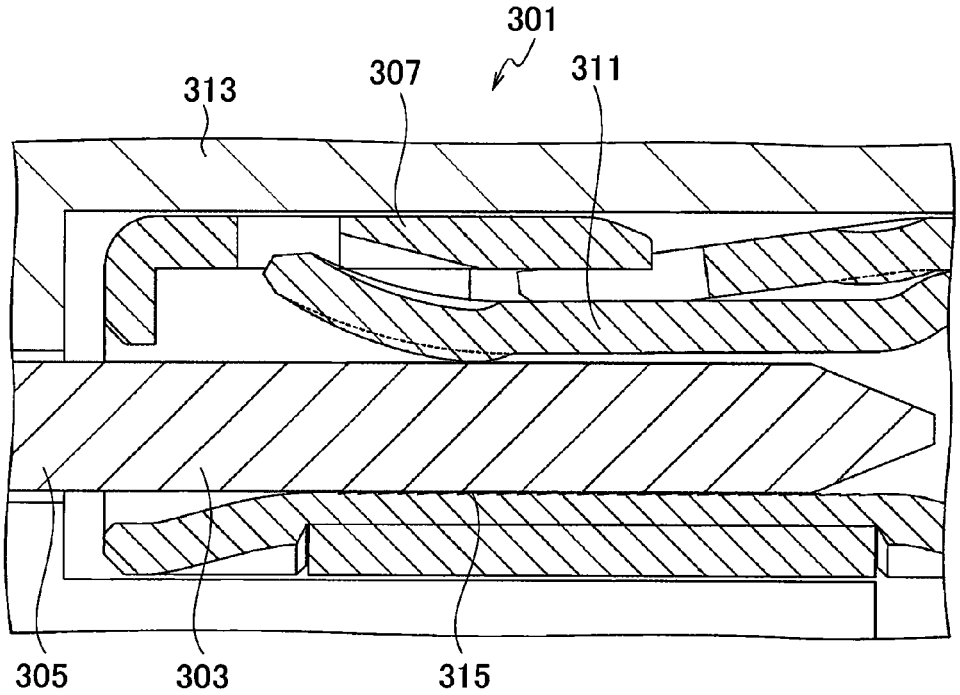
FIG. 10 is a view showing the conventional connection structure of the terminal.
Figure 11:
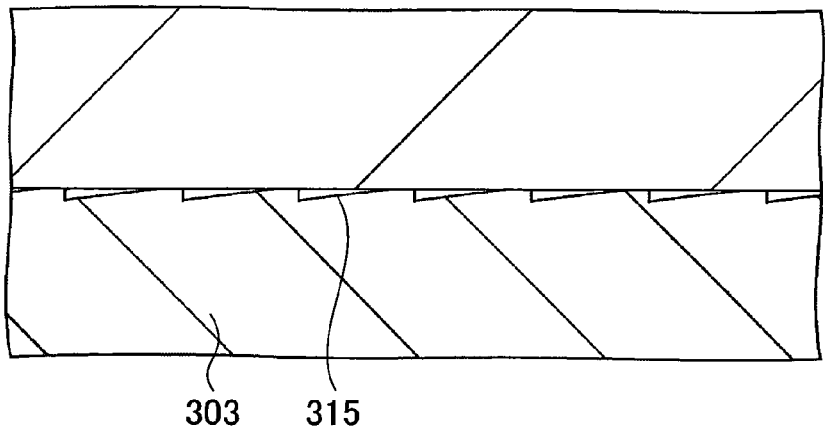
FIG. 11 is a view showing the conventional connection structure of the terminal.
Figure 12:
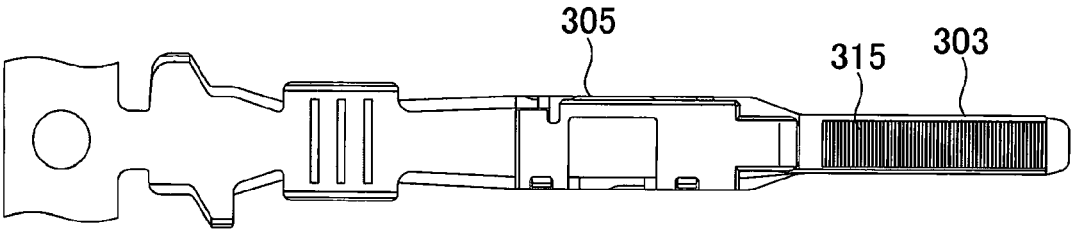
FIG. 12 is a view showing the conventional connection structure of the terminal.

As shown in FIG. 5A and FIGS. 8A, 8B, the nickel layer 21 enters the inside of the recessed portions 77 of the fine asperity 25, and covers the recessed portions 77 and projecting portions 75. Further, while a surface (a surface which is in contact with the tin layer 23) of the nickel layer 21 is formed into a fine asperity pattern by tracing the surface of the base material 19, a surface (a surface on a side opposite to the nickel layer 21) of the tin layer 23 is formed in a flat shape before a minute slide abrasion occurs.

The surface of the nickel layer 21 and the surface of the tin layer 23 may be formed into a fine asperity pattern by tracing the surface of the base material 19.

At the time of forming the male terminal 1 by bending and the like, plastic working such as bending or press working is not applied to portions where the fine asperity 25, the nickel layer 21 and the tin layer 23 are formed. In a macroscopic observation (assuming that the fine asperity 25 is not formed), the portions are formed in a flat surface shape. Since the portions are not plastically deformed, no defect such as a crack occurs in the nickel layer 21 and the tin layer 23.

In a state where the male terminal 1 is connected to the female terminal 3 and a minute slide abrasion does not occur, as shown in FIG. 5A, the tin layer 23 is not shaved at portions where the fine asperity 25, the nickel layer 21 and the tin layer 23 are formed. However, when a minute slide abrasion occurs, a portion of the tin layer 23 is shaved at the projecting portions 9, 13 of the female terminal 3 thus exhibiting a state shown in FIG. 5B.

Here, the fine asperity 25 formed on the tab portion 17 of the male terminal 1 and the like are further explained. Surface roughness Ra (arithmetic average roughness) of the base material 19 brought about by forming a fine asperity 25 is desirably set to 1.15 μm. However, surface roughness Ra may take a value which falls within a range of 1.0 μm to 2.0 μm. Further, surface roughness Ra may also take a value which falls within a range of 0.5 μm to 5.0 μm. Still further, surface roughness Ra may also take a value which falls outside such ranges.

It is sufficient that a thickness of the nickel layer 21 takes a value which falls within a range of 0.5 μm to 3.0 μm. Further, the thickness of the nickel layer 21 may take a value which falls outside the range. It is sufficient that a thickness of the tin layer 23 takes a value which falls within a range of 1.0 μm to 3.0 μm. Further, the thickness of the tin layer 23 may take a value which falls outside the range.

Next, the method for manufacturing the male terminal 1 is described.

The male terminal 1 is manufactured through a base material surface roughening step, a first layer forming step, a second layer forming step, a blanking step, and a forming step in this order.

The method for manufacturing the male terminal 1 is further explained in detail.

Firstly, a surface of a rolled stainless-steel flat plate (material 27) is roughened (base material surface roughening step). A base material surface roughened portion (not shown in the drawing) is arranged just behind a rolled portion shown in FIG. 6, and a surface of the material 27, for example, the whole surface of the material 27 is roughened.

Subsequently, the nickel layer 21 is formed by plating on the whole base material 19 which is roughened in the base material surface roughening step (first layer forming step).

Then, the tin layer 23 is formed by plating on the whole nickel layer 21 formed in the first layer forming step (second layer forming step).

Next, the material on which the tin layer 23 is formed in the second layer forming step is formed into a predetermined shape by blanking (blanking step).

Then, to form the male terminal 1, bending by press forming is applied to the base material 19 on which the nickel layer 21 and the tin layer 23 are formed (forming step).

In the method for manufacturing the male terminal 1, the order of the above-mentioned steps may be changed suitably.

For example, the blanking step, the forming step, the base material surface roughening step, the first layer forming step, and the second layer forming step may be performed in this order. Further, the blanking step, the base material surface roughening step, the first layer forming step, the second layer forming step, and the forming step may be performed in this order.

Further, only the portion which constitutes the connecting portion of the base material 19 may be roughened in the base material surface roughening step. In this case, the surface of the base material 19 may be roughened after performing the rolling shown in FIG. 6.

Although the nickel layer 21 is formed on the whole base material 19 in the first layer forming step, the nickel layer 21 may be formed on only a portion (a portion constituting the connecting portion) of the base material 19 roughened in the base material surface roughening step.

Also in the second layer forming step, in the same manner as the first layer forming step, the tin layer 23 is formed on the whole nickel layer 21 which covers the whole base material 19. However, the tin layer 23 may be formed on only the portion of the nickel layer 21 which is formed on the portion of the base material 19 roughened in the base material surface roughening step.

Figure 5B:
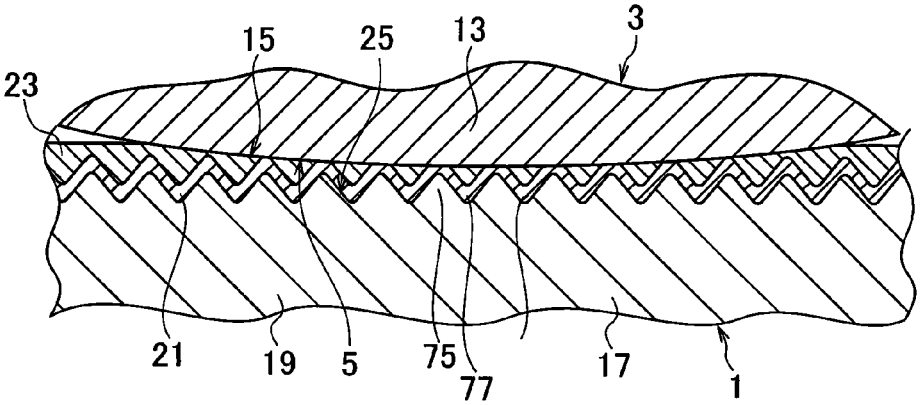
FIG. 5B is an enlarged view of the portion V in FIG. 2 showing a state after a minute slide abrasion occurred.

In the male terminal 1, the tab portion 17 is constituted of: the base material 19 made of stainless steel; the first layer 21 made of nickel and formed on the surface of the base material 19; and the second layer 23 made of tin and formed on the surface of the first layer 21. Accordingly, when the male terminal 1 receives vibrations and a minute slide abrasion occurs in a state where the male terminal 1 is connected to the female terminal 3 and the elastic contact member 11 of the female terminal 3 is brought into elastic contact with the male terminal 1, as shown in FIG. 5B, the plating layer 23 made of tin formed on the contact portion 15 (tab portion 17) is shaved so that abrasion powder is generated and the plating layer 21 made of nickel is exposed. Even in such a case, due to the above-mentioned constitution, the minute slide abrasion does not reach the base material 19 so that there is no possibility that the base material 19 is exposed. Accordingly, even when the conductivity of the base material 19 is low compared to the case where the base material is made of copper, the increase of electric resistance at the contact portion 15 can be prevented.

Further, the first layer 21 is made of nickel and hence, the first layer 21 can be formed on the base material 19 by eliminating a passive film having a large electric resistance which is present on a surface of the base material 19 made of stainless steel.

In the male terminal 1, the fine asperity 25 is formed on the surface of the base material 19 and hence, the respective plating layers 21, 23 can be firmly formed on the base material 19 by an anchoring effect.

Further, in the male terminal 1, the fine asperity 25 extending in the direction orthogonal to the sliding direction of the tab portion 17 is formed on the surface of the base material 19. Accordingly, even when the plating layer made of tin is shaved due to a minute slide abrasion so that the plating layer 21 made of nickel is exposed (see FIG. 5B), the projecting portions 75 and the recessed portions 77 which conform to the fine asperity 25 on the base material 19 are formed also on the surface of the plating layer 21 made of nickel and hence, not the whole plating layer 23 made of tin is removed and the tin layer 23 which enters the recessed portions formed on the plating layer 21 made of nickel remains. The remaining tin layer 23 plays a role of a lubricant and hence, the further progress of abrasion by minute slide can be suppressed whereby the increase of electric resistance can be suppressed.

In the male terminal 1, the extending direction of the fine asperity 25 is equal to the rolling direction of the material 27 and hence, the fine asperity can be easily formed in the same rolling step.

In the male terminal 1, the respective plating layers 21, 23 are formed on the tab portion 17 to which plastic working are not applied. Accordingly, even when the respective plating layers 21, 23 are formed on the base material 19 before bending and the like are performed, there is no occurrence of defects such as cracks in the plating layers 21, 23.

The first layer 21 may include a material other than nickel, and the second layer 23 may include a material other than tin, silver or gold.

That is, it is sufficient for the first terminal 1 that the connecting portion 15 includes: the base material 19 including iron or an iron-based alloy and having the fine asperity 25 on the surface of the base material 19; the first layer 21 formed on the surface of the base material 19 and having the surface formed into a fine asperity pattern; and the second layer 23 formed on the surface of the first layer 21, the first layer 21 is provided for connecting the base material 19 and the second layer 23 to each other, and has higher hardness than the second layer 23, and the second layer 23 is provided for enhancing conductivity and lubrication property.

What is claimed is:

1. A terminal comprising a connecting portion to be connected to a connecting portion of a mating terminal, wherein the connecting portion includes:

a portion of a base material including iron or an iron-based alloy and having a fine asperity on a surface of the portion of the base material;

a first layer formed on a surface of at least the portion of the base material included in the connecting portion and having a surface formed into a fine asperity pattern; and a second layer formed on the surface of the first layer, wherein the first layer is provided for connecting the base material and the second layer to each other, and has higher hardness than the second layer, and the second layer is provided for enhancing conductivity and lubrication property.

2. The terminal according to claim 1, wherein the base material includes stainless steel, the first layer includes nickel, and the second layer includes any one of tin, silver, and gold.

3. The terminal according to claim 1, wherein the fine asperity extends in a direction orthogonal to a sliding direction of the connecting portion or in a direction intersecting the sliding direction of the connecting portion at an almost right angle.

4. The terminal according to claim 1, wherein the connecting portion of the terminal is a tab portion of a male terminal.

5. The terminal according to claim 1, wherein the fine asperity extends in a direction at an angle of between 60 degrees to 120 degrees relative to a sliding direction of the connecting portion to be connected to a connecting portion of a mating terminal.

6. The terminal according to claim 1, wherein the fine asperity extends in a direction at an angle of between 0 degrees to 180 degrees relative to a sliding direction of the connecting portion to be connected to a connecting portion of a mating terminal.

7. The terminal according to claim 1, wherein the fine asperity comprises projecting portions that extend in an elongated manner in a direction orthogonal to a surface of the connecting portion, and recessed portions that extend in an elongated manner in the direction orthogonal to the surface of the connecting portion.

8. The terminal according to claim 1, wherein the fine asperity comprises fine spot-like projecting portions that are spotted at random on the surface of the base material.

9. A method for manufacturing a terminal including a connecting portion to be connected to a connecting portion of a mating terminal, the method comprising:

roughening a surface of a portion of a base material including stainless steel and including the connecting portion to form a fine asperity;

forming a first layer including nickel at least on the surface of the portion of the base material including stainless steel, the first layer including a fine asperity pattern and including the connecting portion; and forming a second layer including any one of tin, silver, and gold on the surface of the first layer which is formed at least on the surface of the portion including the connecting portion.

10. The method according to claim 9, wherein the first layer is integrally formed on the surface of the base material such that the first layer covers the surface of the portion of the base material the second layer is integrally formed on a surface of the first layer such that the second layer covers the surface of the first layer.

11. The method according to claim 10, wherein the second layer is formed on the first layer in an overlapping manner by plating.

12. The method according to claim 9, wherein the roughening the surface comprises roughening the surface by grinding using a grindstone, by transferring a fine asperity formed on a surface of a roller used in rolling the base material, or by a chemical roughening method.

13. The method according to claim 9, wherein the fine asperity extends in a direction orthogonal to a sliding direction of the connecting portion to be connected to a connecting portion of a mating terminal.

14. The method according to claim 9, wherein the fine asperity extends in a direction at an angle of between 60 degrees to 120 degrees relative to a sliding direction of the connecting portion to be connected to a connecting portion of a mating terminal.

15. The method according to claim 9, wherein the fine asperity extends in a direction at an angle of between 0 degrees to 180 degrees relative to a sliding direction of the connecting portion to be connected to a connecting portion of a mating terminal.

16. The method according to claim 9, wherein the fine asperity is formed before the first layer is formed.

17. The method according to claim 9, wherein the fine asperity comprises projecting portions that extend in an elongated manner in a direction orthogonal to a surface of the connecting portion, and recessed portions that extend in an elongated manner in the direction orthogonal to the surface of the connecting portion.

18. The method according to claim 17, wherein the first nickel layer enters the inside of the recessed portions of the fine asperity, and covers the recessed portions and projecting portions.

19. The method according to claim 9, wherein the fine asperity comprises fine spot-like projecting portions that are spotted at random on the surface of the base material.

* * * * *